340813 1189 --00 10-27-81 24750 09-22-81 010727 78147.0 04297672 3638

United States Patent [19]

Fruchey et al.

[11] 4,297,672

[45] Oct. 27, 1981

[54] EARLY WARNING SYSTEM FOR APPROACHING TRANSPORTATION VEHICLES

[75] Inventors: Russell L. Fruchey, Copley; Daniel E. Kupar, Barberton, both of Ohio

[73] Assignee: D.E.W. Line, Inc., Hiram, Ohio

[21] Appl. No.: 118,517

[22] Filed: Feb. 4, 1980

[51] Int. Cl.[3] ..... G08G 1/12

[52] U.S. Cl. ..... 340/23; 340/32

[58] Field of Search ..... 340/32-34, 340/22-24, 171 A, 311; 179/1 VE, 2 EB, 2 E; 455/38, 99, 49; 364/436, 460

[56] References Cited

U.S. PATENT DOCUMENTS 3,644,883 2/1972 Borman et al. ..... 340/23

FOREIGN PATENT DOCUMENTS 2326859 12/1973 Fed. Rep. of Germany ..... 340/23

2347724 4/1975 Fed. Rep. of Germany ..... 340/23

2406266 5/1979 France ..... 340/23

*Primary Examiner*—James J. Groody

*Attorney, Agent, or Firm*—Hamilton, Renner & Kenner

[57] ABSTRACT

A radio signaling system (10) provides advanced warning of an approaching transportation vehicle to passengers within a plurality of predesignated pickup regions, thereby minimizing or eliminating the necessity of spending significant amounts of time at roadside pickup points awaiting the arrival of the vehicle. Radio signaling system (10) includes transmitting system (11) on the vehicle broadcasting a radio-frequency signal modulated with a plurality of low-frequency modulation signals having a code of unique frequencies and sequence for each predesignated pickup region. Radio signaling system (10) also includes receiving system (12) selectively adjustable to provide an alarm output signal only upon receipt of the unique low-frequency modulation code for the predesignated pickup region to which receiving system (12) is proximate.

21 Claims, 5 Drawing Figures

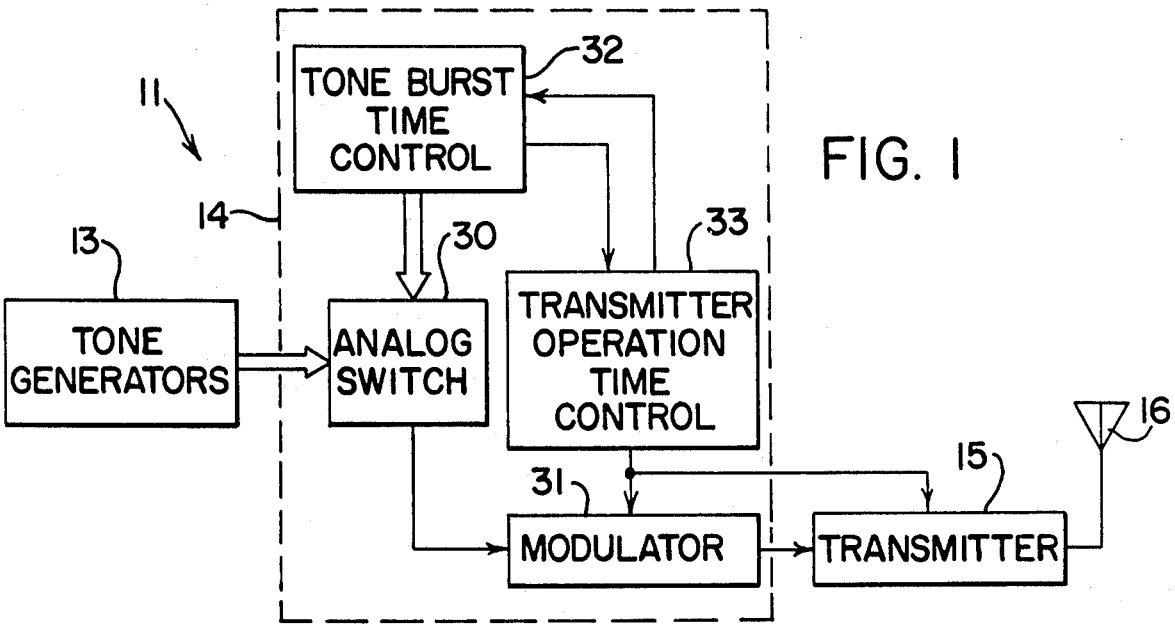
FIG. 1
FIG. 2
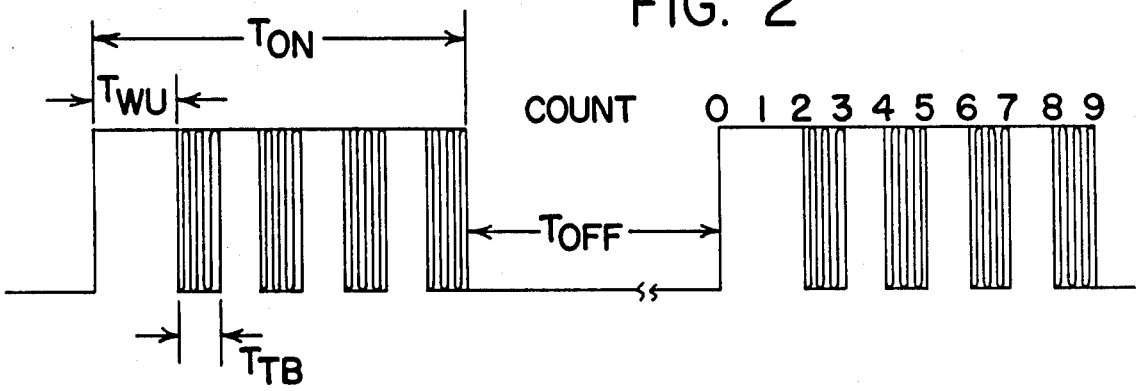
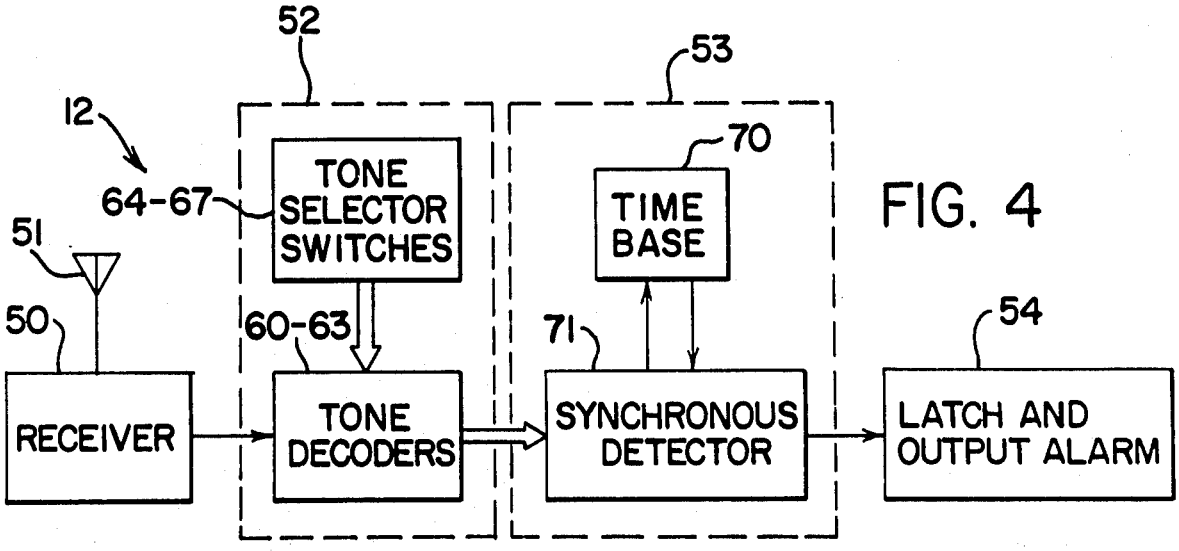
FIG. 4

51
50
RECEIVER
70
TIME BASE
12

52
53
71
64
TONE SELECTOR SWITCH
60
TONE DECODER
72
NOISE SUPPRESSION CIRCUIT
+V1
J
CLK
K
RST
Q
76
65
TONE SELECTOR SWITCH
61
TONE DECODER
73
NOISE SUPPRESSION CIRCUIT
77
66
TONE SELECTOR SWITCH
62
TONE DECODER
74
NOISE SUPPRESSION CIRCUIT
78
54
AUDIBLE ALARM
91
67
TONE SELECTOR SWITCH
63
TONE DECODER
75
NOISE SUPPRESSION CIRCUIT
79
Q̄
93
94
90
LATCH
80

EARLY WARNING SYSTEM FOR APPROACHING TRANSPORTATION VEHICLES

TECHNICAL FIELD

The present invention relates generally to a radio signaling system. More particularly, the present invention relates to a radio signaling system for providing advanced warning of an approaching transportation vehicle to passengers within a plurality of preselected pickup regions.

BACKGROUND ART

Buses have been utilized for years as an economical means of mass transportation, and have recently been gaining in popularity. Moreover, as petrochemical based fueld which power the vast majority of motor vehicles throughout the world become more scarce and costly, the public is being vigorously urged to accelerate its utilization of mass transportation vehicles such as buses to preserve these limited resources.

Unfortunately, the safety and convenience of bus passengers has not kept pace with this growth in utilization. Passengers are universally required to trek to the nearest roadside pickup point and spend significant amounts of time awaiting the arrival of their bus. During periods of inclement weather and in certain neighborhoods spending time outdoors often times can be unhealthy and dangerous. These concerns take on even further significance when the passengers are childrem waiting to be picked up by a scool bus at a location some distance from their homes or relatives waiting to meet the school bus returning with children.

Thus, although there has arisen a great need for an inexpensive remote signaling device which would advise passengers of the imminent arrival of the bus at their pickup point and thereby permit them to remain in a place of relative comfort and safety until immediately prior to the arrival of their bus, no device of this nature has heretofore been available.

DISCLOSURE OF THE INVENTION

It is, therefore, an object of the invention to furnish an economical system for providing advanced warning of an approaching transportation vehicle.

It is another object of the invention to furnish a system for providing advanced warning of an approaching transporation vehicle, as above, employing radio signaling and providing such warning to passengers within a plurality of predesignated pickup regions.

It is still another object of the invention to furnish a system for providing advanced warning of an approaching transporation vehicle, as above, which furnishes a unique combination of low-frequency signals to modulate a radio-frequency signal for each of the predesignated pickup regions.

These and other objects and advantages of the present invention over existing prior art forms will become more apparent and fully understood from the following description in conjunction with the accompanying drawings.

In general, a radio signaling system for providing advanced warning of an approaching transporation vehicle to passengers within a plurality of predesignated pickup region includes a transmitting system on the vehicle and a receiving system in proximity to one of the predesignated pickup regions.

The transmitting system generates a low-frequency-modulated radio-frequency signal and includes a transmitter for generating a radio-frequency signal, a plurality of low-frequency generators for generating a plurality of low-frequency modulation signals, and a modulator circuit for modulating the radio-frequency signal with each of the plurality of low-frequency modulation signal in a preselected sequence. The modulation circuit receives the plurality of low-frequency modulation signals, provides a composite modulation signal including seriatum pulses of each of the plurality of low-frequency modulation signals to the transmitter, and controls both the sequence in which each of the plurality of low-frequency modulation signals is combined and the duration of each pulse.

The receiving system provides an alarm signal only when the transportation vehicle is approaching the predesignated pickup region with which that particular receiving system is associated. The receiving system includes a receiver receiving the low-frequency-modulated radio-frequency signal and providing a demodulated output signal, a plurality of low-frequency decoders receiving the demodulated output signal each of which is tuned to the frequency of one of the plurality of low-frequency generators for providing an output signal upon receipt of that low-frequency signal, a synchronous detector circuit receiving the output signals from all the plurality of low-frequency decoders and providing an alarm output signal only upon receipt of the output signals from the plurality of low-frequency decoders in the preselected sequence, and an alarm circuit receiving the alarm output signal from the synchronous detector circuit and providing an advanced warning of the approaching vehicle to passengers within the predesignated pickup region with which the receiving system is associated.

BRIEF DESCRIPTION OF THE DRAWINGS

FIG. 1 is a block diagram of an exemplary radio signaling transmitting system in accordance with the concept of the present invention.

FIG. 2 is an exemplary low-frequency-modulated radio-frequency output signal generated by the transmitting system depicted in FIG. 1.

FIG. 4 is a block diagram of an exemplary radio signaling receiving system in accordance with the concept of the present invention.

PREFERRED EMBODIMENT FOR CARRYING OUT THE INVENTION

Figure 3:
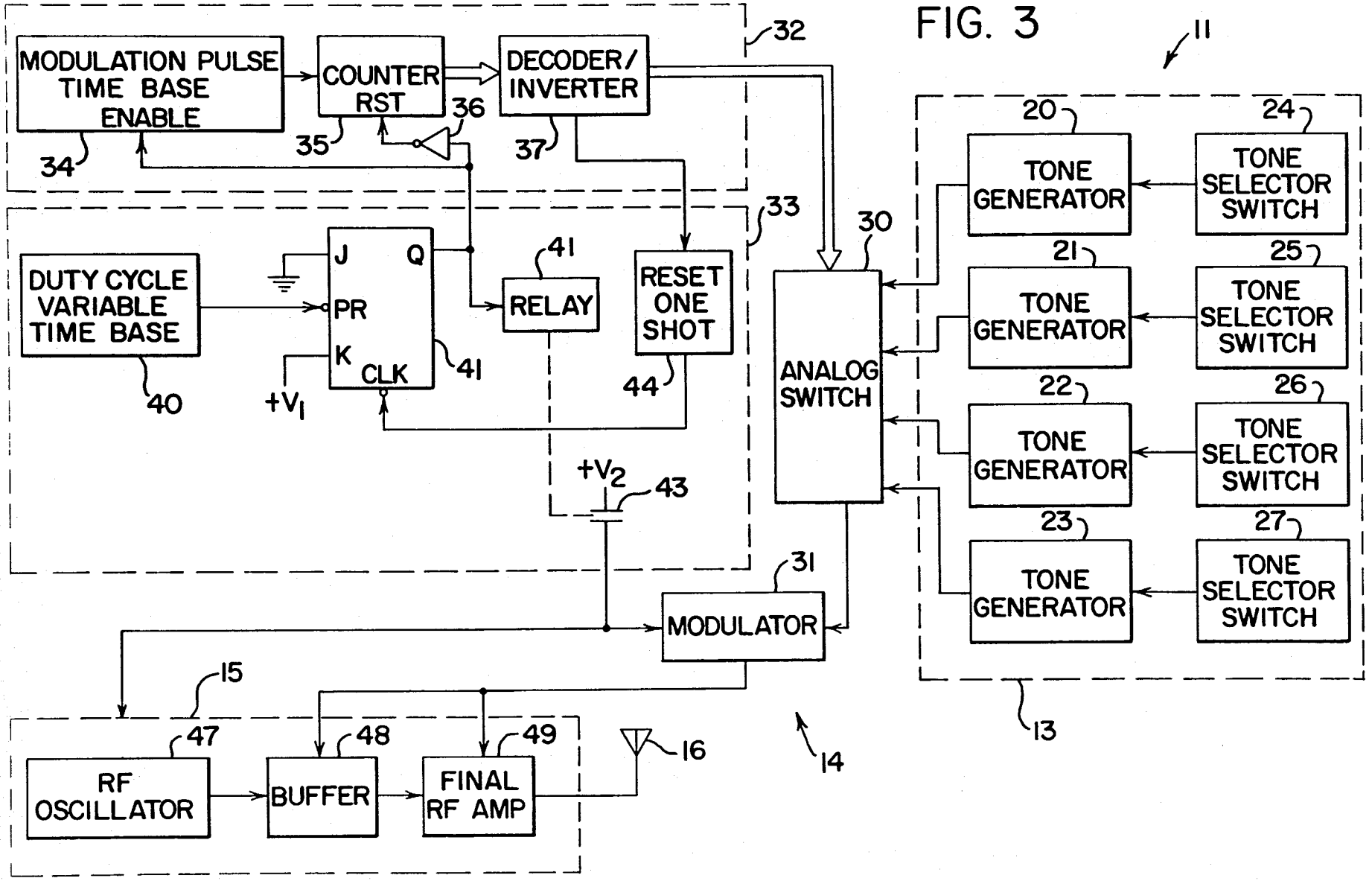
FIG. 3 is a detailed block diagram of the radio signaling transmitting system illustrated in FIG. 1.

A radio signaling system, generally referred to by the numeral 10, for providing advanced warning of an approaching transportation vehicle to passengers within a plurality of predesignated pickup regions broadly includes transmitting and receiving systems, respectively generally indicated by the numerals 11 and 12 in FIGS 1 and 4. As shown in FIG. 1 and in more detail in FIG 3, transmitting system 11 includes tone generators 13 modulator and control circuit 14, and transmitter 15, the output signal from which is radiated in free space by any suitable antenna 16.

Tone generators 13 include a plurality of individua tone generators 20, 21, 22 and 23 and tone selecto switches 24, 25, 26 and 27. Tone generators 20, 21, 22, 23 may be conventional low-frequency generators providing a sinusoidal output frequency that is variable within the audio-frequency spectrum (i.e., from approximately 20 to 20,000 Hz) by adjustment of tone selector switches 24, 25, 26 and 27.

Modulator and control circuit 14 includes analog switch 30, modulator 31, tone burst time control 32, and transmitter operation time control 33. Analog switch 30 may be any of the readily commercially available analog switches, such as Model No. MC14016 manufactured by Motorola, Inc. of Chicago, Illinois, for selectively gating any of a plurality of input signals, in the present instance the output signals from tone generators 20, 21, 22 and 23, to a single output line, which in the present instance is received by modulator 31.

Modulator 31 may be any of the innumerable circuits for modulating a low-frequency signal upon a radio-frequency (hereinafter called RF) carrier. Modulator 31 receives the single output signal from analog switch 30 and modulates the same upon the RF signal generated by transmitter 15 as explained below.

Tone burst time control 32 controls the sequence of and rate at which each of the output signals from tone generators 20, 21, 22 and 23 are switched by analog switch 30 to modulator 31. Tone burst time control 32 includes modulation-pulse time base 34, counter 35, counter reset inverter 36 and decoder and inverter 37. Modulation pulse time base 34 may be an astable multivibrator or clock generating a pulse-train output signal having a frequency equal to the shortest operating period within the desired low-frequency-modulated RF signal. For reasons detailed hereinafter, a modulation pulse time base frequency of 1 Hz, providing pulses having a 1 second period, have been found suitable for use herein.

The pulse-train output signal from modulation-pulse time base 34 is received by counter 35, which may be any counter that is compatible with both modulation-pulse time base 34 and decoder and inverter 37, and capable of incrementing to a count sufficiently large to permit the desired sequencing of the output signals from tone generators 20, 21, 22 and 23 by analog switch 30. Where, as explained hereinafter, ten periods are found to be adequate, counter 35 may be a conventional decade counter having a binary input and a binary-coded-decimal (hereinafter referred to as BCD) output that is resettable through logic inverter 36. Decoder and inverter 37 receives the BCD output count from counter 35 and converts it to a decimal format having a logic convention compatible with analog switch 30, which in turn receives the decimal output from decoder and inverter 37.

Transmitter operation time control 33 controls the duty cycle of transmitter 15, that is the ratio of time an RF signal is broadcast, $T_{ON}$, to the time no RF signal is broadcast, $T_{OFF}$. Transmitter operation time control 33 includes duty-cycle-variable time base 40, J-K flip flop 41, relay 42 having normally open contact 43, and reset one-shot 44. Duty-cycle-variable time base 40 may be a free running astable multivibrator or clock generating a pulse-train output signal having a frequency variable by an internal rheostant (not shown) from approximately one-fifteenth (1/15) to one-one hundred fiftieth (1/150) Hz, thereby providing output pulses every 15 to 150 seconds.

J-K flip flop 41, relay 42, and reset one shot 44 all may be conventional devices connected in the following manner. The pulse train output signal from duty-cycle-variable time base 40 is received by the inverting preset input of J-K flip flop 41. J-K flip flop 41 has its J input terminal connected to ground, its K input terminal connected to a voltage supply $V_1$ of suitable potential to maintain the K input terminal at a high logic level, and provides its Q output signal to the coil (not shown) of relay 42 and to the reset inputs of both modulation-pulse time base 34 and, through inverter 36, counter 35. Reset one shot 44 receives the final count signal from decoder and inverter 37 and thereupon generates a single output pulse to the inverting clock input of J-K flip flop 41. Normally open relay contact 43 has one side connected to a power source of suitable voltage $V_2$, such as a filtered vehicle power supply, and its opposite side connected to both modulator 31 and transmitter 15 as described hereinafter.

Transmitter 15 may be any conventional RF transmitter and may include RF oscillator 47, buffer 48 and final RF amplifier 49. RF transmitter 15 and all its individual components receive the power signal from relay contact 43. RF oscillator 47 provides a RF carrier frequency to buffer 48, which amplifies the RF carrier frequency signal, and also receives the output signal from modulator 31. Final RF amplifier 49 receives the amplified RF carrier frequency from buffer 48, combines the same with the output signal from modulator 31 that is also received by it, and amplifies the resultant low-frequency-modulated RF signal. The output signal from final amplifier 49 is fed to antenna 16 for radiation to receiving systems 12.

Having delineated the detailed construction of transmitting system 11, its operation now may be explained. This operational description shall assume the existence of a fleet of buses each operating on different routes and having a plurality of passenger pickup points along each route. Each bus shall contain a transmitting system 11 and each passenger who desires one may possess a receiving system 12. Before setting forth on its route, each bus operator shall set the particular ordered combination of two audio frequencies previously selected to uniquely identify that route into tone generators 13 by adjustment of tone selector switches 24 and 25. As each bus progresses along its route, the operator would at prescribed locations on the route set the particular ordered combination of two audio frequencies previously selected to uniquely identify the immediately upcoming geographic pickup zones or regions by adjustment of tone selector switches 26 and 27. This would permit transmitter system 11 to broadcast the necessary advanced warning signal to each receiving system 12 within the route segment the bus is then approaching.

In order to more readily understand the specific operation of the exemplary transmitting system 11 shown in FIGS. 1 and 3, the low-frequency-modulated RF signal originating therefrom illustrated in FIG. 2 should first be examined. The waveform of FIG. 2 depicts two RF transmit pulses having duration $T_{ON}$. Each transmit pulse is divided into nine equal segments having a duration equal to the shortest desired operational interval during transmit pulse. In the present instance, the shortest desired operational interval is that for each period of low-frequency modulation of the radio frequency carrier, chosen to be 1 second. All other operational intervals are made a multiple of this basic "tone burst" period, labeled $T_{TB}$. For example, it has been found to be desirable to allow 2 seconds after each transmit pulse is begun to permit transmitter 15 to reach a steady state output, denoted warm-up period $T_{WU}$.

Operation of transmitting system 11 begins with the generation of a pulse signal by duty-cycle-variable time base 40, the high to low logic level transition of which presets J-K flip flop 41 whereby its Q output signal goes to and maintains a high logic level. This in turn simultaneously removes counter 35 from reset, enabling it to begin incrementation from a count of zero, enables modulation-pulse time base 34, and energizes relay 42 so as to close relay contact 43. With relay contact 43 closed, power is immediately supplied to both modulator 31 and transmitter 15, resulting in the generation and broadcast of the RF carrier by transmitter 15.

Enabled by J-K flip flop 41, modulation-pulse time base 34 increments decade counter 35 at 1 second intervals. The decoded output signals from decoder and inverter 37 causes analog switch 30 to sequentially gate the output signals from tone generators 20, 21, 22 and 23 to modulator 31 between counts 2 and 3, 4 and 5, 6 and 7, and 8 and 9, respectively. The result is that for 2 seconds transmitter 15 broadcasts only its RF carrier and for every other of the next seven 1 second intervals the RF carrier is sequentially modulated with the selected audio tone signals from tone generators 20, 21, 22 and 23.

Prior to the time at which counter 35 reaches count 9 the pulse output from duty-cycle-variable time base 40 has gone to a high logic level, permitting J-K flip flop 41 to change the logic level of its Q output signal upon receipt of the next clock input pulse. When counter 35 reaches count 9, the output signal from decoder and inverter 37 triggers reset one shot 44 which provides a single pulse that clocks J-K flip flop 41, thereby changing its Q output signal to a low logic level. This in turn immediately disables modulation-pulse time base 34 so that counter 35 is no longer incremented, and de-energizes relay 42, opening relay contact 43. With relay contact 43 open, power is immediately cut off from both modulator 31 and transmitter 15, resulting in termination of the generation and broadcast of the RF carrier by transmitter 15.

Transmitter 15 remains inactive until the next pulse high to low logic level transition is generated by duty-cycle-variable time base 40, presetting J-K flip flop 41 and beginning a new operating cycle as just outlined above. Inasmuch as the time during which an RF signal is broadcast is fixed through a combination of the pulse period of modulation-pulse time base 34 and the maximum count of counter 35, variation of the time between pulses from duty-cycle-variable time base 40, which directly controls the time between which successive RF pulses are broadcast, similarly controls the duty cycle of the low-frequency-modulated RF signal radiated by transmitter 15.

Figure 5:
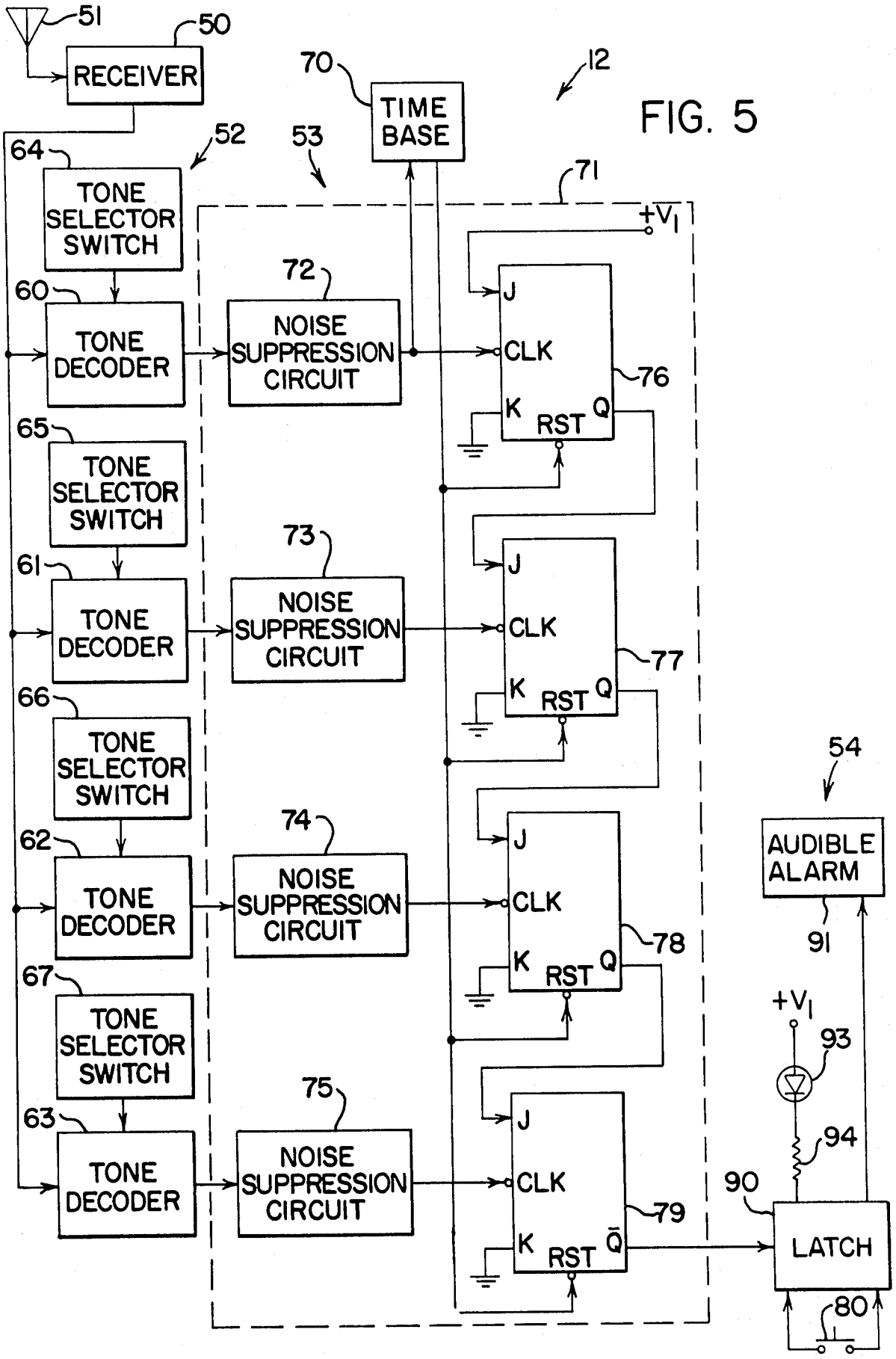
FIG. 5 is a detailed block diagram of the radio signaling receiving system shown in FIG. 4, schematically depicting some elements thereof.

Referring now to FIGS. 4 and 5, an exemplary receiving system 12 can be seen to include a receiver 50 receiving the radiated low-frequency-modulated RF signal through antenna 51, tone decoders circuit 52, synchronous detector circuit 53, and latch and output alarm 54. Receiver 50 may be any conventional receiver for providing the low-frequency component of the modulated RF signal to tone decoders circuit 52, although the superheterodyne type receiver has been found to be convenient for use herewith and provides adequate sensitivity.

Tone decoders circuit 52 includes a like plurality of individual tone decoders 60, 61, 62 and 63 and tone selector switches 64, 65, 66 and 67 as that of tone generators 13. Tone decoders 60, 61, 62 and 63 may be any of the commercially available tone decoders, such as the phase-lock-loop tone decoder manufactured by National Semiconductor Corporation of Santa Clara, California having Model number LM567, capable of selective tuning to low frequencies within the audio frequency spectrum by adjustment of tone selector switches 64, 65, 66 and 67 and providing an output signal upon reception of a signal having the frequency to which that tone decoder is tuned.

Synchronous detector circuit 53 insures that alarm 54 is activated only upon receipt of the preselected sequence of tones for the region in which receiving system 12 is assigned to operate. Synchronous detector circuit 53 includes time base 70 and synchronous detector 71, which in turn includes like pluralities of noise suppression circuits 72, 73, 74 and 75, and J-K flip flops 76, 77, 78 and 79.

Noise suppression circuits 72, 73, 74 and 75, respectively, receive the output signals from tone decoders 60, 61, 62 and 63 and provide a sharply defined transition from one to the other logic level compatible with J-K flip flops 76, 77, 78 and 79 whenever tone decoders 60, 61, 62 and 63 first receive or discontinue receiving the audio tone signal to which they are tuned. The output signals from noise suppression circuits 72, 73, 74 and 75 are respectively received by the inverted clock inputs to J-K flip flops 76, 77, 78 and 79.

The J input of J-K flip flop 76 is connected to power supply $V_1$, fixing that input at a high logic level. The K inputs of all J-K flip flops 76, 77, 78 and 79 are connected to ground. J-K flip flops 76, 77, 78 and 79 are cascaded, the Q output signal from J-K flip flop 76 being received by the J input of J-K flip flop 77, the Q output signal from J-K flip flop 77 being received by the J input of J-K flip flop 78, and the Q output signal from J-K flip flop 78 being received by the J input of J-K flip flop 79. Connected in this manner the $\overline{Q}$ output signal from J-K flip flop 79 will only go to a low logic level when J-K flip flops 76, 77, 78 and 79 are sequentially clocked, which can only occur when tone decoders 60, 61, 62 and 63 receive the audio tone signals to which the same are tuned and in which order they occur.

Time base 70 may be any conventional monostable multivibrator or one-shot receiving the output signal from noise suppression circuit 72 and generating a single output pulse having a duration and logic level noted below whenever the output signal from noise suppression circuit 72 goes from a low to a high logic level, indicative of the receipt of the audio tone to which tone decoder 60 is tuned. This output pulse is received by the inverting reset terminal of each J-K flip flop 76, 77, 78 and 79. The duration of the output pulse from time base 70 should be slightly longer than the time between counts 2 and 9 of counter 35, which would be slightly more than 7 seconds in the example herein.

Latch and output alarm 54 may include a conventional latch 90 for retaining the present $\overline{Q}$ output signal from J-K flip flop 79, a manual reset pushbutton 80, and any compatible audible alarm 91 such as a buzzer connected to latch 90. In addition to or instead of audible alarm 91, a visual alarm may be supplied, such as LED 93 whose cathode is connected, through pull-up resistor 94, to latch 90 and whose anode is connected to power supply $V_1$.

Operation of receiving system 12 is straightforward Initially, tone selector switches 64, 65, 66 and 67 ar adjusted to tune tone decoders 60, 61, 62 and 63, respectively, to the preselected tones and in the predesignated sequence which represents the unique radio signaling alarm code for the region in which receiving system 12 is to operate. Such adjustment may either be made once the region of interest is known prior to delivery of receiving system 12 to its user, or may be made by the user who is given the proper tones and sequence for the region of interest.

During operation tone decoders 60, 61, 62 and 63 continually monitor the low frequency component of the received RF signal from receiver 50. Upon receipt of the preselected audio tone to which tone decoder 60 is tuned, the output signal from tone decoder 60 causes the output signal from noise suppression circuit 72 to go to a high logic level. When the output signal from noise suppression circuit 72 goes to a high logic level, the output of time base 70 is triggered to go to a high logic level, removing from reset and thereby enabling J-K flip flops 76, 77, 78 and 79. When the preselected audio tone to which decoder 60 is tuned is no longer received, the output signal from noise suppression circuit 72 returns to a low logic level, which transition clocks J-K flip flop 76 and sets its Q output to a high logic level. Once the Q output signal from J-K flip flop 76 goes to a high logic level, J-K flip flop 77 is enabled. If the next audio tone to be received is that to which tone decoder 61 is tuned, J-K flip flop 77 will be clocked and J-K flip flop 78 enabled in a similar manner. This process would continue until tone decoder 63 receives the audio tone to which it is tuned ultimately resulting in the $\overline{Q}$ output signal from J-K flip flop 79 going to a low state and setting the output signal from latch 90 to the same, whereupon both audible alarm 91 and LED 93 would be activated.

The output signal from time base 70 returns to the low logic level after slightly more than 7 seconds, resetting and disabling flip flops 76, 77, 78 and 79. If the correct sequence of the other three audio tones following the one which activates tone decoder 60 are not received within this time period no alarm output signal may be provided. This significantly reduces the chance of false activation of latch and output alarm 54.

Once activated audible alarm 91 and LED 93 would remain in that condition until latch 90 is manually reset by pushbutton 80 which would return the output signal from latch 90 to a high logic level and disable audible alarm 91 and LED 93.

Selection of the particular audio frequencies to be employed with radio signaling system 10 is a function of the specific application selected. For example, where radio signaling system is to be utilized with a school bus system in a rural community where the various bus routes and pickup locations are widely separated, a narrower separation between frequencies may be acceptable without providing interference. In particular, where the selected audio frequencies have only 200 Hz separation, transmitter 15 has an RF output power level of approximately 5 watts and is tuned to the remote control carrier frequency of 27.255 MHz, and a superheterodyne type receiver 50 utilized, a substantially interference-free, effective radio signaling range of several miles is achieved.

Several modifications suitable for incorporation into radio signaling system 10 should be noted. First, the particular quantity of tone generators may be changed in accordance with the parameters of the specific application of radio signaling system 10. For example, when utilized in a densely populated urban area with overlapping bus routes, a greater number of tone generators may be desirable. Conversely in a rural area with a few widely scattered bus routes, fewer than four tone generators may be adequate.

A second modification that should now be evident is the use of modulation waveforms other than the sinusoidal low-frequency waveforms illustrated herewith. Although sinusoidal waveforms where chosen herein for their low cost and availability, the spectral density of other modulation waveforms may be preferable for overcoming other electromagnetically noisy environments.

The frequency of modulation-pulse time base 34 has been chosen to be 1 Hz herein, principally to allow sufficient time for tone detectors 60, 61, 62 and 63 of the phase-lock-loop type to lock-in on the received modulation signal. Of course, where other detection circuits or modulation waveforms are employed the frequency of modulation-pulse time base 34 may be suitably varied.

The skilled artisan should recognize that the audio tone frequencies and modulation technique employed in the preferred embodiment is a type of multiple-frequency frequency-shift keying. It should be readily apparent that the concept of the present invention includes any of the multitude of other suitable types of modulation, such as amplitude and phase shift methods.

It should also be noted that in describing the construction and operation of the logic elements within radio signaling system 10, the so-called "positive true logic" convention has been adopted. As would be understood by a skilled artisan, any other circuits employing a similar or different logic convention could be utilized to implement the desired functions, and when so utilized clearly fall within the scope of the present invention.

Inasmuch as the present invention is subject to many variations, modifications and changes in detail, a number of which have been expressly stated herein, it is intended that all matter described throughout this entire specification or shown in the accompanying drawings be interpreted as illustrative and not in a limiting sense. It should thus be evident that a device constructed according to the concept of the present invention, and reasonably equivalent thereto, will accomplish the objects of the present invention and otherwise substantially improve the art of providing advanced warning of an approaching transportation vehicle to passengers within a plurality of predesignated pickup regions.

We claim:

1. A radio signaling system for providing advanced warning of an approaching transportation vehicle to passengers within a plurality of predesignated pickup regions, comprising:

transmitting system means on the vehicle for generating a low-frequency-modulated radio-frequency signal including transmitter means for generating a radio-frequency signal, a plurality of low-frequency generators for generating a plurality of low-frequency modulation signals, and, modulator and control circuit means for modulating said radio-frequency signal with each said plurality of low-frequency modulation signals in a preselected sequence, including analog switch means for receiving each of said plurality of low-frequency modulation signals and selectively gating the same to said transmitter means, modulation-pulse time control means for generating an output signal to said analog switch means to control the sequence of and rate at which said low-frequency modulation signals are gated by said analog switch means and generating a cycle-complete output signal after all said plurality of low-frequency modulation signals have been gated to said transmitter means by said analog switch means, and transmitter operation time control means for selectively gating power to said transmitter means and thereby controlling the duration said transmitter means generates said radio-frequency signal, and receiving said cycle-complete output signal and generating an output signal for controlling said modulation-pulse time control means, said output signal for controlling said modulation-pulse time control means disabling the same upon receipt of said cycle-complete output signal and subsequently enabling the operation of said modulation-pulse time control means in synchronization with said gating of power to said transmitter means; and, receiving system means in proximity to a predesignated pickup region for providing an alarm signal only when the transportation vehicle is approaching the predesignated pickup region with which that particular receiving system means is associated including receiver means receiving said low-frequency-modulated radio-frequency signal and providing a demodulated output signal, a plurality of low-frequency decoders receiving said demodulated output signal each of which is tuned to the frequency of one of said plurality of low-frequency generators for providing an output signal upon receipt of that low-frequency signal, synchronous detector means receiving said output signals from all said plurality of low-frequency decoders and providing an alarm output signal only upon receipt of said output signals from said plurality of low-frequency decoders in said preselected sequence, and, alarm means receiving said alarm output signal from said synchronous detector means and providing an advanced warning of the approaching vehicle to passengers within the predesignated pickup region with which said receiving system is associated.

2. A radio signaling system, as set forth in claim 1, wherein said modulator and control circuit means further includes modulator means receiving said gated low-frequency modulation signals from said analog switch means and providing a modulation signal to said transmitter means, said transmitter operation time control means gating power to said modulator means.

3. A radio signaling system, as set forth in claim 2, wherein said modulation-pulse time control means includes modulation-pulse clock means for generating a pulse train output signal, counter means receiving said pulse train output signal from said modulation-pulse clock means, counting the number of pulses in the same, and providing an output signal indicative of the instantaneous count, and decoder means receiving said instantaneous count output signal from said counter means and providing decoded count output signals to said analog switch means and said transmitter operation time control means, one of said decoded count output signals being said cycle complete output signal.

4. A radio signaling system, as set forth in claims 2 or 3, wherein said transmitter operation time control means includes transmitter operation clock means for generating a pulse train output signal, flip flop means for receiving said pulse train output signal from said transmitter operation clock means and providing said output signal for controlling said modulation-pulse time control means, one-shot means for receiving said cycle complete output signal from said modulation-pulse time control means and generating a single pulse to reset said flip flop means, and relay means for receiving said output signal for controlling said modulation-pulse time control means from said flip flop means and selectively gating power to said modulator means and said transmitter means.

5. A radio signaling system, as set forth in claims 1 or 3, wherein said synchronous detector means includes a plurality of cascaded flip flops each receiving said output signal from one of said plurality of low-frequency decoders, the final said flip flop in said plurality of cascaded flip flops providing said alarm output signal.

6. A radio signaling system, as set forth in claim 5, wherein said synchronous detector means further includes time base means for receiving said output signal from the first of said plurality of low-frequency decoders also providing its output signal to the first said flip flop in said plurality of cascaded flip flops, said time base means generating an output pulse to enable all said plurality of cascaded flip flops upon receipt of said output signal from the first of said plurality of low-frequency decoders.

7. A radio signaling system, as set forth in claim 6, wherein the duration of said output pulse from said time base means is slightly larger than the time which said radio-frequency signal is modulated by said plurality of low-frequency modulation signals, said cascaded flip flops being disabled at all times other than during receipt of said output pulse from said time base means.

8. A radio signaling system, as set forth in claim 7, wherein said synchronous detector means further includes a plurality of noise suppression circuits each receiving said output signal from one of said plurality of low-frequency decoders and providing a substantially noise-free output signal to one of said plurality of cascaded flip flops for toggling the logic level of the output signal of that particular said flip flop.

9. A radio signaling system, as set forth in claim 5 wherein said alarm means includes latch means and means for providing an audible alarm.

10. A radio signaling system, as set forth in claim 5 wherein said alarm means includes latch means and means for providing a visual alarm.

11. A radio signaling transmitting system for providing advanced warning of an approaching transportation vehicle to passengers within a plurality of predesignated pickup regions, comprising:

transmitter means on the vehicle for generating radio-frequency signal;

a plurality of low-frequency generators for generating a plurality of low-frequency modulation signals; and, modulator and control circuit means for modulating said radio-frequency signal with each said plurali of low-frequency modulation signals in a preselected sequence, said modulator and control circuit means including, analog switch means for receiving each of said plurality of low-frequency modulation signals and selectively gating the same to said transmitter means, modulation-pulse time control means for generating an output signal to said analog switch means to control the sequence of and rate at which said low-frequency modulation signals are gated by said analog switch means and generating a cycle-complete output signal after all said plurality of low-frequency modulation signals have been gated to said transmitter means by said analog switch means, and transmitter-operation time control means for selectively gating power to said transmitter means and thereby controlling the duration said transmitter means generates said radio-frequency signal, and receiving said cycle-complete output signal and generating an output signal for controlling said modulation-pulse time control means, said output signal for controlling said modulation-pulse time control means disabling the same upon receipt of said cycle-complete output signal and subsequently enabling the operation of said modulation-pulse time control means in synchronization with said gating of power to said transmitter means.

12. A radio signaling transmitting system, as set forth in claim 11, wherein said modulator and control circuit means further includes modulator means receiving said gated low-frequency modulation signals from said analog switch means and providing a modulation signal to said transmitter means, said transmitter operation time control means gating power to said modulator means.

13. A radio signaling transmitting system, as set forth in claim 12, wherein said modulation-pulse time control means includes modulation-pulse clock means for generating a pulse train output signal, counter means receiving said pulse train output signal from said modulation-pulse clock means, counting the number of pulses in the same, and providing an output signal indicative of the instantaneous count, and decoder means receiving said instantaneous count output signal from said counter means and providing decoded count output signals to said analog switch means and said transmitter operation time control means, one of said decoded count output signals being said cycle complete output signal.

14. A radio signaling transmitting system, as set forth in claims 12 or 13, wherein said transmitter operation time control means includes transmitter operation clock means for generating a pulse train output signal, flip flop means for receiving said pulse train output signal from said transmitter operation clock means and providing said output signal for controlling said modulation-pulse time control means, one-shot means for receiving said cycle-complete output signal from said modulation-pulse time control means and generating a single pulse to reset said flip flop means, and relay means for receiving said output signal for controlling said modulation-pulse time control means from said flip flop means and selectively gating power to said modulator means and said transmitter means.

15. A radio signaling receiving system for use with a transmitting system broadcasting a radio-frequency signal modulated by a plurality of low-frequency modulation signals for providing advanced warning of an approaching transportation vehicle to passengers within a plurality of predesignated pickup regions, the plurality of low-frequency modulation signals having unique frequencies and sequences for each pickup region, comprising:

receiver means receiving the low-frequency modulated radio-frequency signal and providing a demodulated output signal, a plurality of low-frequency decoders receiving said demodulated output signal each of which is tuned to one of the frequencies assigned to the pickup region in which the receiving system is to operate for providing an output signal upon receipt of that low-frequency signal, synchronous detector means receiving said output signals from all said plurality of low-frequency decoders and providing an alarm output signal only upon receipt of said output signals from said plurality of low-frequency decoders in the unique sequence assigned to the pickup region in which the receiving system is to operate, and, alarm means receiving said alarm output signal from said synchronous detector means and providing an advanced warning of the approaching vehicle to passengers within the predesignated pickup region with which the receiving system is associated.

16. A radio signaling receiving system, as set forth in claim 15, wherein said synchronous detector means includes a plurality of cascaded flip flops each receiving said output signal from one of said plurality of low-frequency decoders, the final said flip flop in said plurality of cascaded flip flops providing said alarm output signal.

17. A radio signaling receiving system, as set forth in claim 16, wherein said synchronous detector means further includes time base means for receiving said output signal from the first of said plurality of low-frequency decoders also providing its output signal to the first said flip flop in said plurality of cascaded flip flops, said time base means generating an output pulse to enable all said plurality of cascaded flip flops upon receipt of said output signal from the first of said plurality of low-frequency decoders.

18. A radio signaling system, as set forth in claim 17, wherein the duration of said output pulse from said time base means is slightly larger than the time which said radio-frequency signal is modulated by said plurality of low-frequency modulation signals, said cascaded flip flops being disabled at all times other than during receipt of said output pulse from said time base means.

19. A radio signaling receiving system, as set forth in claim 18, wherein said synchronous detector means further includes a plurality of noise suppression circuits each receiving said output signal from one of said plurality of low-frequency decoders and providing a substantially noise-free output signal to one of said plurality of cascaded flip flops for toggling the logic level of the output signal of that particular said flip flop.

20. A radio signaling receiving system, as set forth in claim 16, wherein said alarm means includes latch means and means for providing an audible alarm.

21. A radio signaling receiving system, as set forth in claim 16, wherein said alarm means includes latch means and means for providing a visual alarm.

* * * * *